US005730035A

United States Patent [19]

Ohmori et al.

[11] Patent Number: 5,730,035

[45] Date of Patent: Mar. 24, 1998

[54] PNEUMATICALLY OPERATED SCREW DRIVER

[75] Inventors: Yasuki Ohmori; Mitsuo Ogura; Yasuo Sasaki, all of Hitachinaka, Japan

[73] Assignee: Hitachi Koki Co., Ltd., Tokyo, Japan

[21] Appl. No.: 655,941

[22] Filed: May 31, 1996

[30] Foreign Application Priority Data

Jun. 9, 1995 [JP] Japan ..... 7-143165

[51] Int. Cl.[6] ..... B25B 21/00

[52] U.S. Cl. ..... 81/57.44; 173/93.5

[58] Field of Search ..... 81/57.44, 57.37, 81/433, 431, 434; 173/93.5, 13, 93

[56] References Cited

U.S. PATENT DOCUMENTS 5,186,084 2/1993 Totsu ..... 81/433 X 5,231,902 8/1993 Uno et al. ..... 81/57.44

*Primary Examiner*—D. S. Meislin

*Attorney, Agent, or Firm*—Sughrue, Mion, Zinn, Macpeak & Seas, PLLC

[57] ABSTRACT

A pneumatically operated screw driver having a moving unit rotatable about its axis by rotation of a rotor and movable axially by a pneumatic pressure. The moving unit includes a spline shaft supported by the rotor through a ball spline, and a drive bit aligned with the spline shaft and engageable with a head of a screw. The spline shaft has an annular flange portion. A movable piston is disposed concentrically over the spline shaft and movable in an axial direction thereof with respect to the spline shaft. A spring is disposed over the spline shaft and is interposed between the movable piston and the flange portion. A stop member is provided to a rotor or a frame body. If pneumatic pressure is applied to the movable piston, the latter is axially moved downwardly and is brought into abutment with the stop member. The spline shaft is also moved axially slightly after the movement of the movable piston. The shrinkage of the spring will generate shape-restoration force thereof to further move the spline shaft after the stop of the movable piston.

13 Claims, 6 Drawing Sheets

RELATED ART

PNEUMATICALLY OPERATED SCREW DRIVER

BACKGROUND OF THE INVENTION

The present invention relates to a pneumatically operated screw driver, and more particularly, to such driver capable of providing stabilized screw fastening operation yet reducing counteraction or kick from a work-piece to be screwed.

A conventional pneumatically operated screw driver is disclosed in a U.S. Pat. No. 5,231,902. The disclosed driver is adapted to drive a screw so as to fix a relatively soft panel board such as a plaster staff to a relatively rigid member such as a wood. The screw driver includes a pneumatically rotatable rotor and a relatively light weight moving unit vertically movably supported in the rotor and rotatable together with the rotation of the rotor. The moving unit has a lower portion provided with a drive bit adapted to engage a screw head. The moving unit is moved downwardly along with its rotation about its axis, so as to rotate and move downwardly the drive bit for screw driving operation.

With this arrangement, impact force can be reduced, and a compact screw driver can be provided because only the moving unit is moved downwardly, and as a result, operability can be improved. However, because the moving unit is moved pneumatically, a particular structure is required so as to deal with variation in pneumatic pressure. Further, if excessive pneumatic pressure is applied, the device may function as if it is a hammer. Therefore, sufficient threading or screwing engagement between the screw and the workpiece cannot be provided. Furthermore, when a tip end of the screw abuts the surface of the workpiece, the downwardly moved moving unit may be suddenly stopped due to the resistance from the workpiece. This generate reaction force, which causes floating or jumping up of the entire screw driver, to render the screw driving operation inoperative.

SUMMARY OF THE INVENTION

One inhouse proposal has been made so as to provide an improved screw driver capable of reducing the counteraction. According to the inhouse proposal, a movable piston is coaxially movably supported on a moving unit. That is, a movable piston has an inverted cup shape whose top wall is in sliding contact with the moving unit. The moving unit has a flange at a position below the movable piston. A spring is coaxially disposed over the moving unit and is interposed between the top wall and the flange. If the compressed air pressure is applied to the top wall of the movable piston, the movable piston is moved downwardly. In this case, the moving unit is also moved downwardly, since the spring urges the flange downwardly. If a tip of the screw abuts a workpiece, the moving unit is stopped suddenly. However, the movable piston is moved downwardly by the compressed air pressure with further compressing the spring. That is, the deformation of the spring absorbs the counteraction from the workpiece.

FIGS. 9 and 10 show operational principle of the inhouse proposal. In FIG. 9, the movable piston 203 is moved downwardly by the compressed air pressure P, so that a drive bit 209 of the moving unit is moved downwardly through the spring 204 to drive a screw 10 into a workpiece W. After the tip end of the screw 10 abuts the surface of the workpiece W, the movable piston 203 is further moved downwardly by the compressed air pressure P, while the drive bit 209 is subjected to resistance as described above. However, because the spring 204 can further be shrunk, reactive force from the workpiece W can be moderated.

Even though counteraction from the workpiece W upon abutment of the tip end of the screw 10 onto the workpiece W can be reduced in the inhouse proposal, compressed air pressure is always applied to the movable piston 203 and to the moving unit through the spring 204. As a result, a frame body 201 may be urged upwardly by the compressed air pressure. To be more specific, the movable piston 203 may not be easily moved downwardly because of the resistance from the workpiece W, whereas the frame body 201 may be easily moved upwardly with sliding over the movable piston 203 by the compressed air pressure P, to cause upward movement of the frame body 201.

The upward movement of the frame body 201 causes separation of the tip of the drive bit 209 from a groove of a head of the screw 10. Therefore, insufficient screw driving operation results. Further, in the inhouse proposal, since the compressed air pressure is always applied to the movable piston 203 and to the moving unit during the screw driving operation, hammering rather than screw fastening may be provided if compressed pressure level is increased. Accordingly sufficient threading engagement between the screw 10 and the workpiece W may not be provided.

It is therefore, an object of the present invention to overcome the above described drawbacks and to provide an improved pneumatically operated screw driver.

Another object of the invention is to provide such screw driver capable of performing stabilized screw driving operation regardless of variation in pneumatic pressure, while sufficiently reducing counteraction from the work-piece.

These and other objects of the present invention will be attained by a pneumatically operated screw driver for driving a screw for threading engagement with a workpiece, comprising a frame body connected to a compressed air source, a pneumatic motor, a moving units, rotation transmitting means, a movable piston, a resilient members, and a stop member. The pneumatic motor is supported in the frame body and is rotatable about its axis by the compressed air. The moving unit is movable in an axial direction thereof and extends through the pneumatic motor. The moving unit includes a drive bit engageable with a head of the screw and having an flange. The transmission means is adapted for transmitting rotation of the pneumatic motor to the moving unit to rotate the moving unit about its axis. The transmitting means allows the moving unit to axially move therethrough. The movable piston is supported on the moving unit and is movable with respect to the moving unit in the axial direction thereof. The resilient member is connected between the movable piston and the flange of the moving unit. The moving unit is movable in the axial direction thereof by the axial movement of the movable piston through the resilient member which is compressed. The stop member is provided within the frame body at a stationary position and is abuttable against the movable piston for stopping axial movement of the movable piston. The moving unit is further movable by a restoration force of the resilient member after the stop of the movable piston.

Screw driving operation is primarily performed by the shape-restoration force of the resilient member as a result of its shrinkage. Therefore, stabilized screw driving operation is achievable regardless of the variation in pressure of the compressed air. Further, counteraction due to the compressed air pressure can be nullified by the abutment of the movable piston against the stop member when the tip of the screw abuts the relatively rigid workpiece. Accordingly, screw driving operation can further be stabilized.

DETAILED DESCRIPTION OF THE PREFERRED EMBODIMENTS

Figure 1:
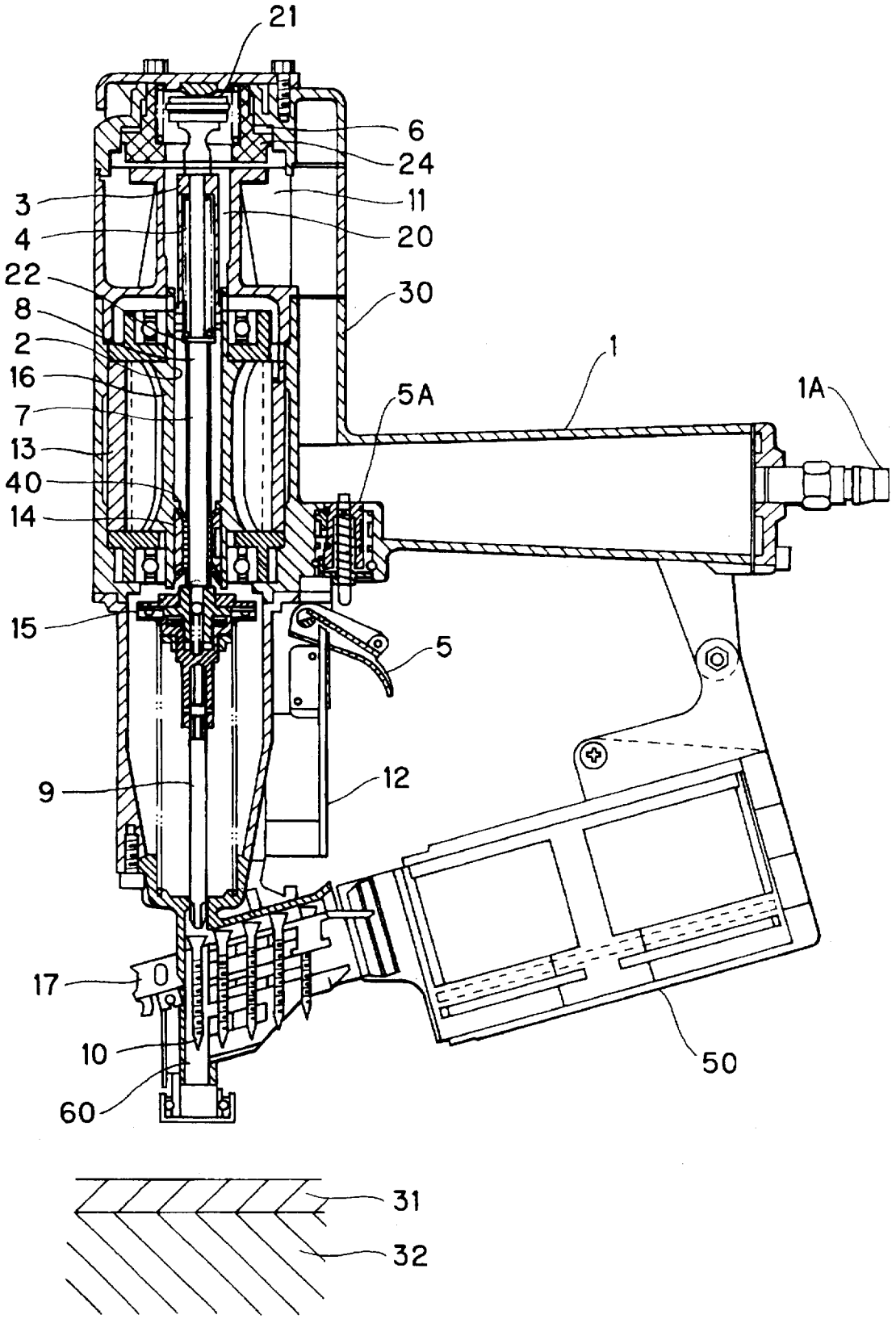
FIG. 1 is a cross-sectional view showing a pneumatically operated screw driver according to a first embodiment of the present invention and showing a state prior to the screw driving operation.

A pneumatically operated screw driver according to a first embodiment of this invention will be described with reference to FIGS. 1 through 4.

The screw driver includes an outer frame body 1 which provides a main housing 30, a magazine 50 and a nose portion 60 positioned below the main housing 30. The frame body 1 has a connection port 1A connected to a compressed air source (not shown). The magazine 50 is adapted to accommodate therein fasteners such as screws 10 which are held side by side by a band 17. Each one of the screw 10 is transferred to the nose portion 60 in a conventional manner for driving the screw 10 into a workpiece such as a plaster staff 31 and a base member 32 to which the plaster staff 31 is to be attached.

A push lever 12 is vertically movably supported to the nose portion 60. The push lever 12 has an upper end engageable with a trigger 5 provided to the frame body 1 and a lower end portion surrounding the nose portion 60. The push lever 12 is movable upward when the nose portion 60 presses against the workpiece 31 in a conventional manner. In accordance with the upward movement of the push lever 12, the trigger 5 can be manipulated to operate a trigger valve 5A to thus start screw driving operation in a well known manner.

Figure 3:
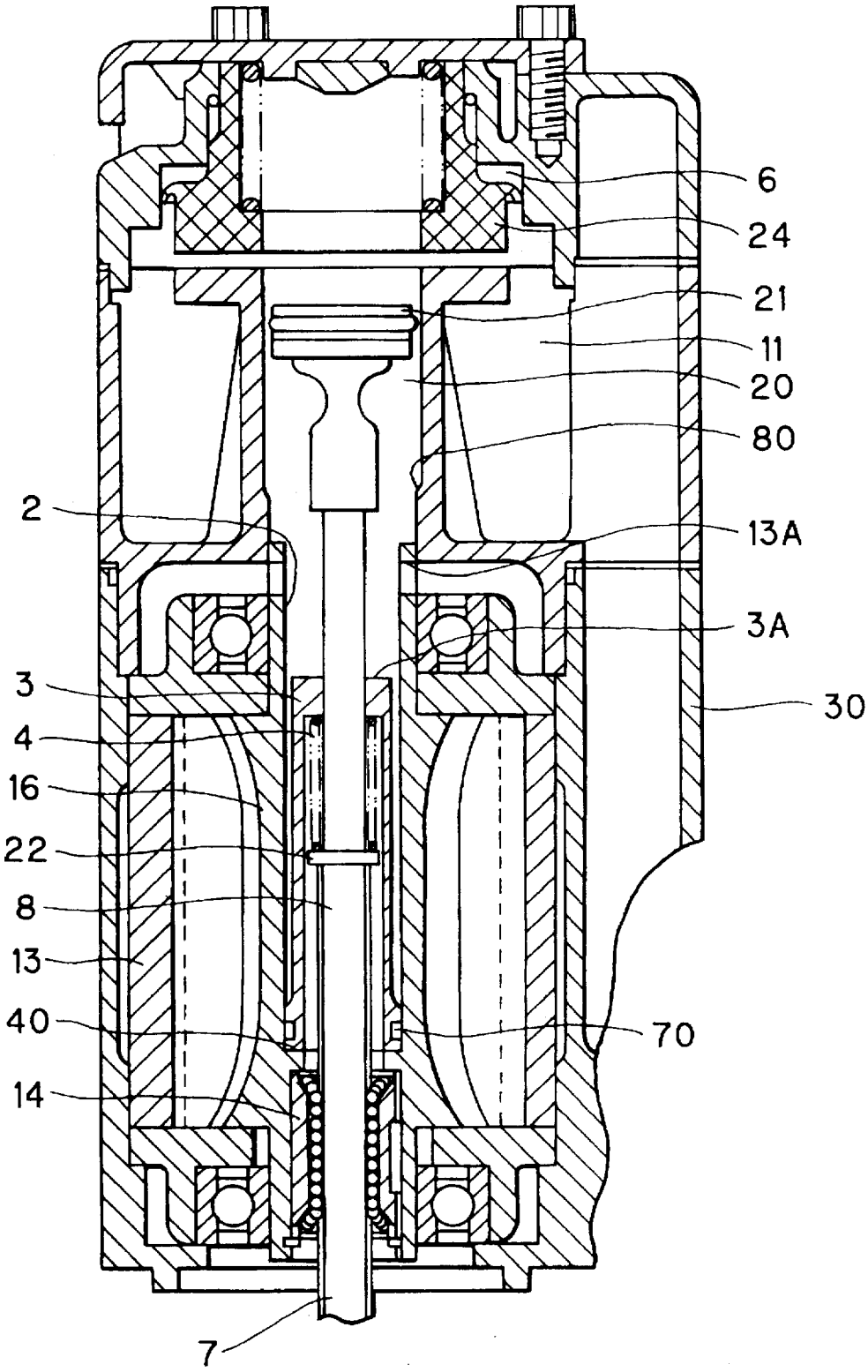
FIG. 3 is an enlarged cross-sectional view showing an essential portion of the pneumatically operated screw driver according to the first embodiment of the present invention and showing the initial screw driving operation state.

In the main housing 30, a pressure accumulation chamber 11 is provided. Further, at a vertically intermediate portion of the main housing 30, a pneumatic motor 13 and a moving unit 7 are housed. The pneumatic motor 13 includes a rotor 16 whose inner peripheral surface defines a cylinder 2. The rotor 16 has an air supply passage 13A (FIG. 3). At a lower portion of the cylinder 2, a radially inwardly projecting annular stop portion 40 is provided. Further, at a position immediately below the annular stop portion 40, a ball spline 14 is provided.

An air inlet passage 20 is provided above the cylinder 2 and extends through the pressure accumulation chamber 11 for applying compressed air into the air supply passage 13A. The air inlet passage 20 extends coaxially with the cylinder 2 of the rotor 16 and has a stepped portion 80.

Further, a head valve 24 is disposed above the air inlet passage 20 so as to selectively block fluid communication between the pressure accumulation chamber 11 and the air inlet passage 20. A head valve chamber 6 is provided above the head valve 24. Similar to the conventional arrangement, the head valve 24 is normally urged downwardly by the compressed air in the head valve chamber 6. Further, in the conventional manner, the head valve 24 is movable upwardly by the compressed air in the pressure accumulation chamber 11 when compressed air in the head valve chamber 6 is discharged upon operation of the trigger valve 5A which is operated by manipulation of the trigger 5. As a result, compressed air in the air accumulation chamber 11 is flowed into the air inlet passage 20.

The moving unit 7 includes a spline shaft 8, a drive bit 9 and a valve seal portion 21. These components are integrally rotated together and vertically moved together. The spline shaft 8 is rotatable by the rotation of the rotor 16 through the ball spline 14 disposed at the lower portion of the rotor 16. The spline shaft 8 has an annular flange or projection 22. The drive bit 9 is positioned below the spline shaft 8 and is connected thereto by a clutch 15, and the valve seal portion 21 is positioned above the spline shaft 8 and has a larger diameter than that of the spline shaft 8. The clutch 15 is adapted to shut off the coupling between the spline shaft 8 and the drive bit 9 when the screw fastening force reaches a predetermined level. The valve seal portion 21 is adapted to seat on the stepped portion 80 of the air inlet passage 20 so as to block fluid communication between the air inlet passage 20 and the pneumatic motor 13 when the moving unit 7 is moved downwardly by a predetermined amount whereupon the screw driving is completed. Thus amount of consumption of the compressed air can be reduced.

A movable piston 3 is provided movably with respect to the moving unit 7 in the cylinder 2. The movable piston 3 is supported movably on the spline shaft 8 and disposed over the annular projection 22. More specifically, the movable piston 3 has a hollow cylindrical shape having an upper end wall 3A through which the spline shaft 8 slidably extends. The movable piston 3 has a lower open end portion whose outer peripheral end portion is provided with a seal ring 70 which is in slide contact with the cylinder 2. A mass of the movable piston 3 is relatively small among the entire moving unit 7. A compression spring 4 is coaxially disposed around the spline shaft 8 and is interposed between the upper end wall 3A and the annular projection 22. Small compression force of the spring 4 is sufficient to operate the screw driving operation. Further, the axially deforming stroke of the spring 4 is greater than the driving stroke of the screw 10 into the plaster staff 31 and the base member 32 to which the plaster staff 31 is to be attached. To this effect, the lower end face of the movable piston 3 is abuttable against the radially inwardly projecting annular stop portion 40 for preventing the movable piston 3 from being further moved downwardly.

In operation, before pressing the nose portion 60 against the surface of the workpiece 31, as shown in FIG. 1, the push lever 12 has its upper position relative to the trigger 5. Further, in this state, the head valve 24 is positioned at its lower position to block fluid communication between the pressure accumulation chamber 11 and the air inlet passage 20. Therefore, compressed air in the pressure accumulation chamber 11 cannot be introduced into the pneumatic motor 13.

If the frame body 1 is moved toward the workpiece 31, and the nose portion 60 presses the workpiece 31, the push lever 12 is moved upwardly. Then, when the trigger 5 is manipulated, the trigger valve 5A is operated, so that the compressed air in the head valve chamber 6 is discharged for moving the head valve 24 upwardly. By the upward movement of the head valve 24, the compressed air in the pressure accumulation chamber 11 can be introduced into the air inlet passage 20 for applying pneumatic pressure into the rotor 16 through the air supply passage 13A to rotate the rotor 16. Further, since the lower end of the movable piston 3 is in sealing contact with the cylinder 2 by the seal ring 70 and since the movable piston 3 has relatively small mass, the movable piston 3 is moved downwardly relative to the spline shaft 8 by the compressed air introduced into the air inlet passage 20, and as a result, the lower end face of the movable piston 3 is brought into abutment with the radially inwardly projecting annular stop portion 40.

Further, shortly after the downward movement of the movable piston 3, the moving unit 7 starts downward movement, because the spring 4 presses the annular projection 22. More specifically, when the downward movement of the movable piston 3 is started, the spring 4 is merely compressed, so that the spline shaft 8 does not axially move. If the movable piston 3 further moves downwardly, the restoration force of the spring 4 will urges the annular projection 22, so that the moving unit 7 will start downward movement shortly after the downward movement of the movable piston 3. It goes without saying that the moving unit 7 is rotated about its axis during downward movement thereof since the rotation of the rotor 16 is transmitted to the spline shaft 8 through the ball spline 14.

Figure 2:
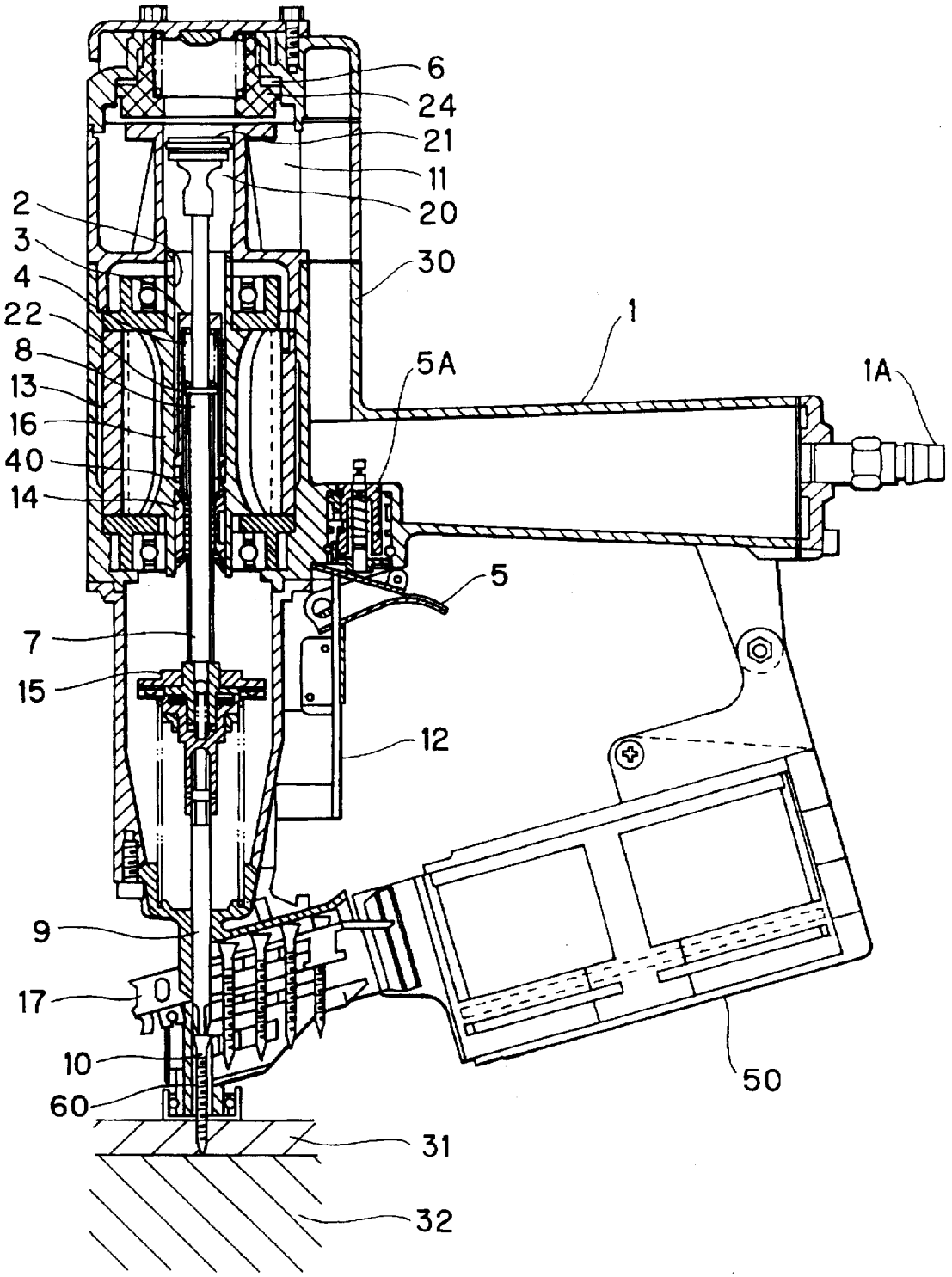
FIG. 2 is a cross-sectional view showing the pneumatically operated screw driver according to the first embodiment of the present invention and showing a state of initial screw driving operation.

Because of the downward movement of the moving unit 7, the drive bit 9 abuts the screw 10, so that the screw 10 is separated from the band 17 and is screwed into the workpiece 31 as shown in FIG. 2. If the screw 10 has penetrated the soft plaster staff 31 and abuts the hard base member 32, the screw 10 is subjected to resistive force, so that the downward moving speed of the moving unit 7 is immediately reduced.

In this state, the moving unit 7 is urged downwardly by the compressed air pressure, whereas the frame body 1 is urged upwardly by the compressed air pressure. However, since the lower end face of the movable piston 3 abuts the annular stop portion 40, the upward movement of the frame body 1 is prevented. Accordingly, upward movement of the entire screw driver is avoidable. In other words, the upward urging force is canceled by the downward urging force. Consequently, no resultant upward force is provided to the frame body 1 during screw driving operation into the base member 32. This implies that the floating or jumping of the frame body 1 from the screw 10 does not occur due to the counteraction from the rigid workpiece 32.

Figure 4:
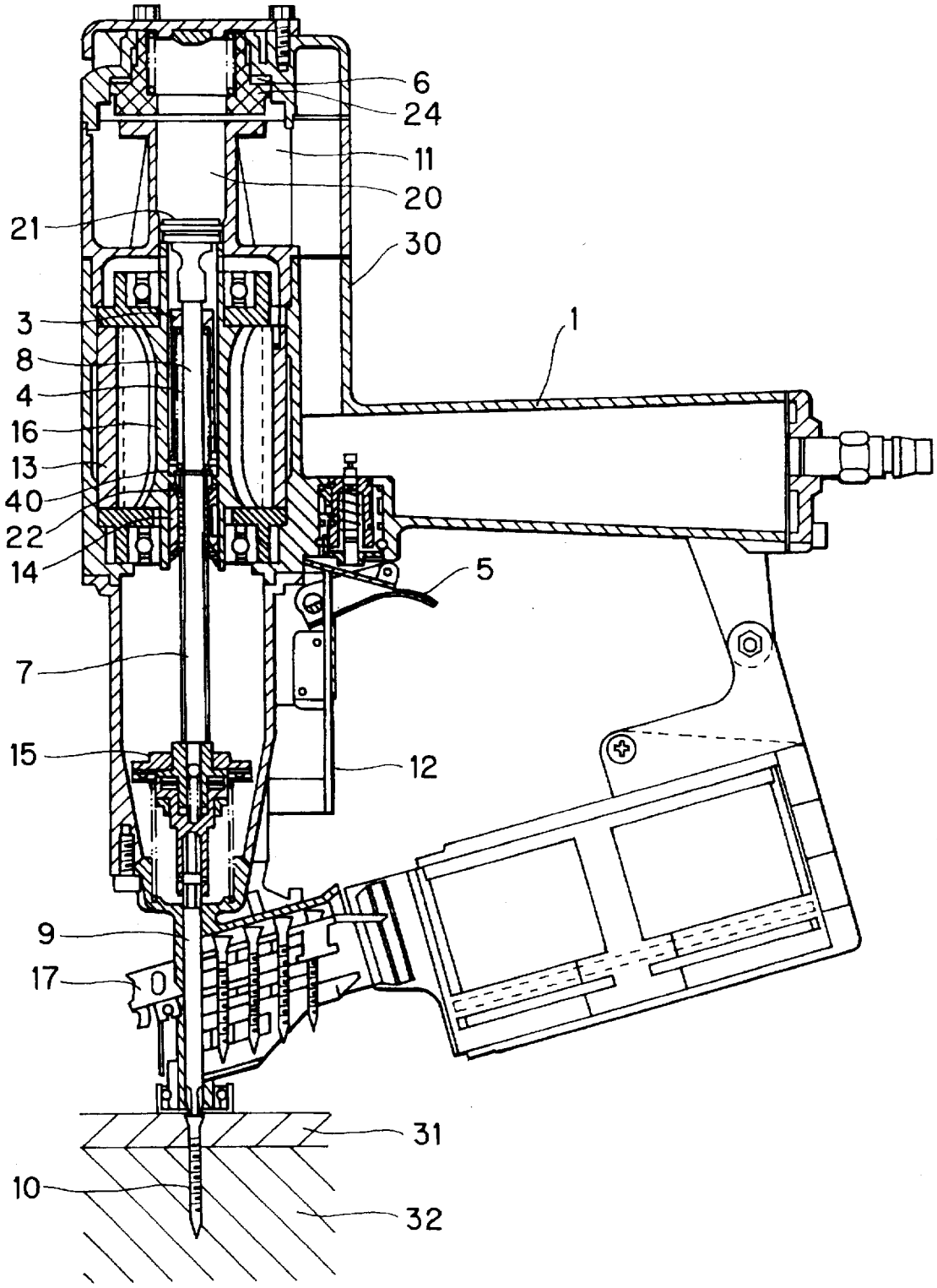
FIG. 4 is a cross-sectional view showing the pneumatically operated screw driver according to the first embodiment of the present invention and showing a final phase of the screw driving operation.

After the movable piston 3 abuts the annular stop portion 40, the moving unit 7 is moved downwardly by almost only the restoration force of the spring 4. Even though the compressed air pressure is exerted on the top surface of the valve seal portion 21 for moving the moving unit 7 downwardly, the inner pressure within the cylinder 2 resists the downward movement of the valve seal portion 21. Therefore, the difference between the areas of the upper and lower surfaces of the valve seal portion 21 may cause movement of the moving unit 7. However, this difference is the cross-sectional area of the spline shaft 8, and therefore, may be negligible. Accordingly, the downward moving force of the moving unit 7 is given only by the restoration force of the spring 4, and the screw 10 can surely be screwed into the workpieces 31 and 32 as shown in FIG. 4, where the spring 4 almost restores its original length. In other words, in the final stage, the screw driving operation can be made only by the spring force regardless of the variation in compressed pressure.

At the final phase of the screw driving operation, the moving unit 7 is downwardly moved with a constant force by the spring 4. Therefore, the force of engagement between the drive bit 9 and the groove of the head of the screw 10 can be maintained approximately constantly. Further, since the frame body 1 does not jump upwardly due to the counteraction from the rigid workpiece 32, accidental separation of the drive bit 9 from the groove of the screw head can be prevented. Furthermore, since compressed air does not contribute the screw driving operation in the final phase, excessive driving force is not imparted on the drive bit 9. Therefore, the screw 10 is stably screwed into the workpiece 32 without forcible penetration of the screw 10 relative to the workpiece 32, and as a result, a stable threading engagement of the screw 10 with the workpiece 32 can be obtained.

A pneumatically operated screw driver according to a second embodiment of the present invention will be described with reference to FIGS. 5 and 6 wherein like parts and components are designated by the same reference numerals as those of the first embodiment. In the first embodiment, the fluid communication between the air inlet passage 20 and the pneumatic motor 13 is blocked by the valve seal portion 21 at the completion phase of the screw driving operation in order to save the compressed air. To this effect, axial length of the moving unit 7 including the valve seal portion 21 must be increased, which in turn increases the vertical length of the frame body 1. The second embodiment is provided in an attempt to obviate this drawback.

In the second embodiment, a movable piston 103 is positioned below a ball spline 114 so as to reduce the length of the upper part of the frame body 101. To this effect, a rotor 116 of a pneumatic motor 113 has a downwardly extending sleeve portion 116A extending into a lower internal space of the main housing 130, and the movable piston 103 is provided slidably with respect to the sleeve portion 116A. Similar to the first embodiment, the movable piston 103 has an upper portion provided with an end wall 103A, and a lower portion being opened. A seal ring 170 is provided at the outer peripheral portion of the end wall 103A to maintain hermetic seal between the movable piston 103 and the inner peripheral sliding surface of the sleeve portion 116A.

A spline shaft 108 is provided as a moving unit 107. The spline shaft 108 has a lower end portion provided with a radially outwardly projecting flange 122 and an upper end portion provided with a large diameter portion 108A. A spring 4 is interposed between the end wall 103A and the flange 122. A stop member 140 corresponding to the annular stop portion 40 of the first embodiment is provided at a bottom of the main housing 130 and at a position confronting a lower end face of a movable piston 103. The lower end face of the movable piston 103 is abuttable on the stop member 140.

The frame body 101 has a horizontal wall 180 at a position nearby a head valve 24. The horizontal wall 180 has a circular hole. Further, a cylindrical movable seal member 151 is disposed coaxially over the moving unit 107 and at the position above the ball spline 114. The movable seal member 151 has an upper annular flange portion 151A to which a seal ring 151B is attached. The movable seal member 151 has a cylindrical portion whose outer diameter is smaller than an inner diameter of the circular hole of the horizontal wall 180. Therefore, air inlet passage 120 is provided between the outer peripheral surface of the cylindrical portion of the movable seal member 151 and the cylindrical opening of the horizontal wall 180.

The seal ring 151B is abuttable on the upper surface of the horizontal wall 180 at a position around the circular hole thereof. Further, in the annular flange portion 151A, a plurality of radial passages 151*a* are formed for allowing compressed air to flow into the hollow space of the seal member 151. A lower end portion of the movable seal member 151 is provided with a radially inwardly projecting annular rib 151C.

The rotor 116 has an upper stepped portion 116B, and a spring 152 is interposed between the upper stepped portion 116B and a lower end face of the annular rib 151C for normally urging the movable seal member 151 upwardly. An outer diameter of the upper large diameter portion 108A of the moving unit 107 is smaller than an inner diameter of the cylindrical movable seal member 151, and the upper large diameter portion 108A is abuttable on the annular rib 151C.

Figure 6:
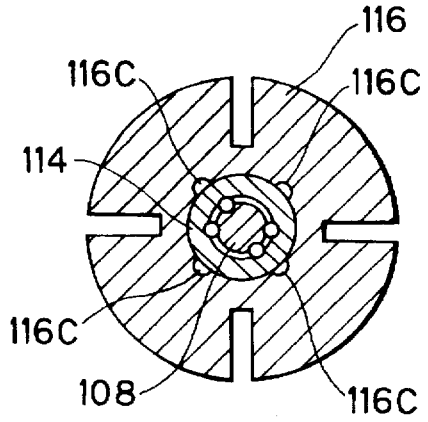
FIG. 6 is a cross-sectional view taken along the line V—V of FIG. 5.

As shown in FIG. 6, the rotor 116 is formed with a plurality of fluid passage 116C at an inner peripheral surface portion in contact with an outer peripheral surface of the ball spline 114. Therefore, a compressed air flowed into the cylindrical movable seal member 151 through the radial passages 151*a* can be delivered to the upper surface of the movable piston 103 through the fluid passage 116C.

Figure 5:
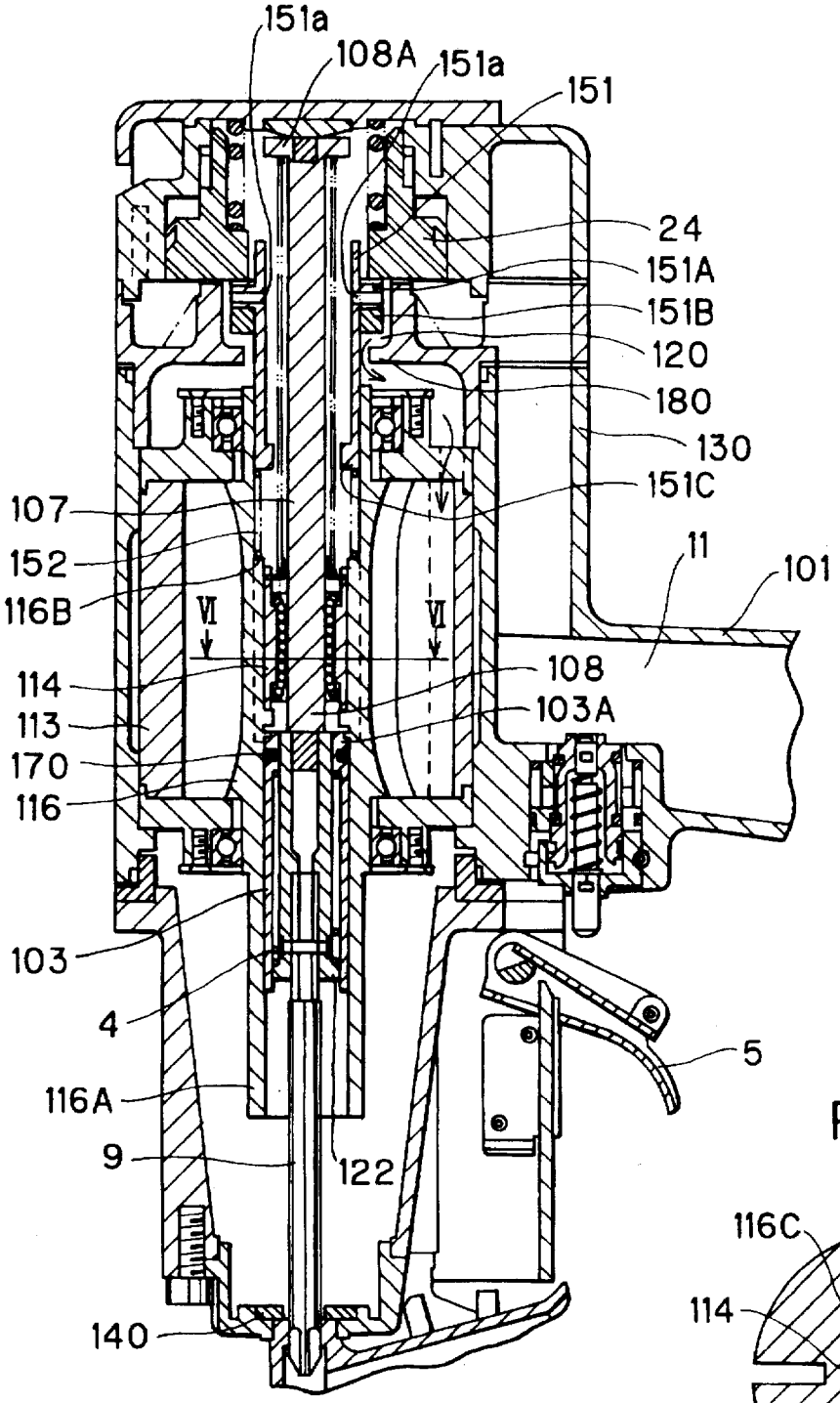
FIG. 5 is an enlarged cross-sectional view showing an essential portion of a pneumatically operated screw driver according to a second embodiment of the present invention.

In operation, when the head valve 24 is moved upwardly, upon manipulation of the trigger 5, the compressed air in the pressure accumulation chamber 11 is flowed into the air inlet passage 120, and the compressed air is flowed into the rotor 116 as indicated by arrows in FIG. 5. As a result, the rotor 116 is rotated, and accordingly the spline shaft 108 is rotated through the ball spline 114. Further, the compressed air is also flowed into the inside of the cylindrical movable seal member 151 through the radial passages 151*a*. Therefore, the compressed air is applied to the top surface of the movable piston 103 through the air passages 116C. Since the movable piston 103 has a relatively small mass, the movable piston 103 is moved downwardly by the compressed air relative to the spline shaft 108 with gradually compressing the spring 4.

The downward movement of the movable piston 103 is stopped when the lower end of the movable piston 103 abuts the stop member 140. During this downward movement, the moving unit 107 begins to move downwardly, since the lower end of the spring 4 pushes the flange 122 of the moving unit 107 after the predetermined shrinkage of the spring 4. By the downward movement of the moving unit 107, the screw 10 is urged downwardly by the drive bit 9 and is released from the band 17(FIG. 1), and the tip end of the screw 10 abuts against the workpiece 32.

If the screw 10 has penetrated the soft plaster staff 31 and abuts the hard base member 32, the screw 10 is subjected to resistive force, so that the downward moving speed of the moving unit 107 is immediately reduced. In this state, the moving unit 107 is urged downwardly by the compressed air pressure, whereas the frame body 101 is urged upwardly by the compressed air pressure. However, since the lower end face of the movable piston 103 abuts the stop member 140 of the frame body 101, the upward movement of the frame body 101 is prevented. Accordingly, upward movement of the entire screw driver is avoidable. In other words, the upward urging force is canceled by the downward urging force. Consequently, no resultant upward force is provided to the frame body 101 during screw driving operation into the base member 32. This implies that the floating or jumping of the frame body 101 from the screw 10 does not occur due to the counteraction from the rigid workpiece 32.

When the moving unit 107 is moved downwardly by a predetermined distance, the upper large diameter portion 108A abuts the annular rib 151C, so that the movable seal member 151 is moved downwardly together with the moving unit 107 against the biasing force of the spring 152. In the downward movement of the movable seal member 151, the seal ring 151B is brought into abutment with the upper surface of the horizontal wall 180, so that fluid communication between the pneumatic motor 113 and the air inlet passage 120 is blocked to avoid waste of the compressed air.

In the second embodiment, length of the upper part of the frame body 101 can be reduced because of the arrangement of the movable seal member 151 and associated movable piston 103. Therefore, a compact screw driver results, and operability can be enhanced.

Figure 7:
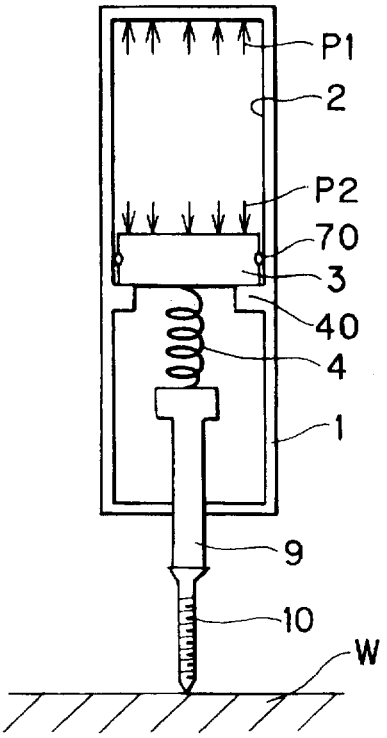
FIG. 7 is a schematic view showing an operation principle of the present invention and showing an initial state of screw driving operation.
Figure 8:
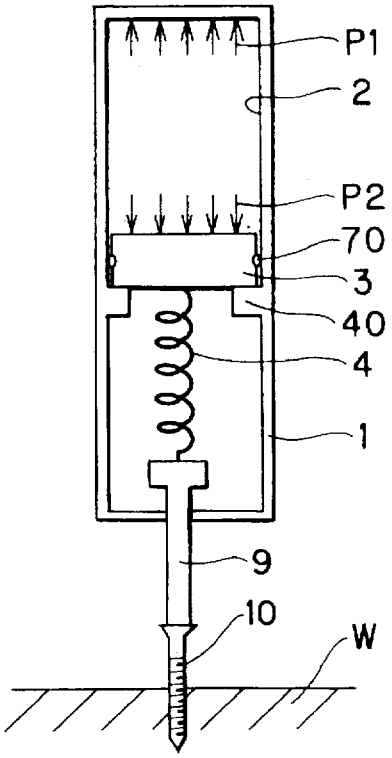
FIG. 8 is a schematic view showing an operation principle of the present invention and showing a final phase of the screw driving operation.

In summary, FIGS. 7 and 8 illustrate the operational principle of the present invention. According to the present invention as shown in FIG. 7, the moving piston 3 abuts the stop member 40 by the compressed air, and the spring 4 is maximumly compressed when the tip of the screw 10 abuts the rigid workpiece W. Thereafter, the screw 10 is screwed into the workpiece W by the restoration force of the spring 4 as shown in FIG. 8. In this case, pressure balance is provided between the pressures P1 and P2, and therefore, the frame body 1 does not move upwardly. In other words, the upward force P1 is blocked by the abutment between the piston 3 and the stop member 40.

Figure 9:
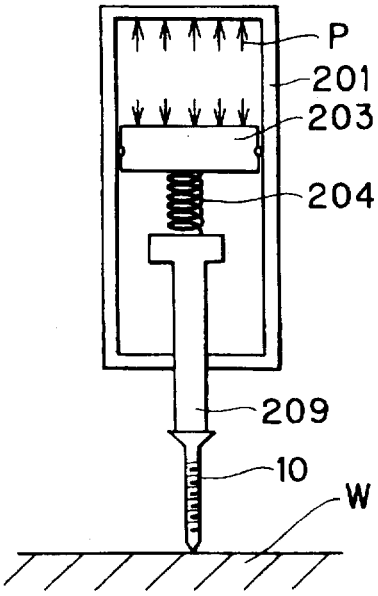
FIG. 9 is a schematic view showing an operation principle of an inhouse proposal through R & D activities and showing an initial state of screw driving operation.
Figure 10:
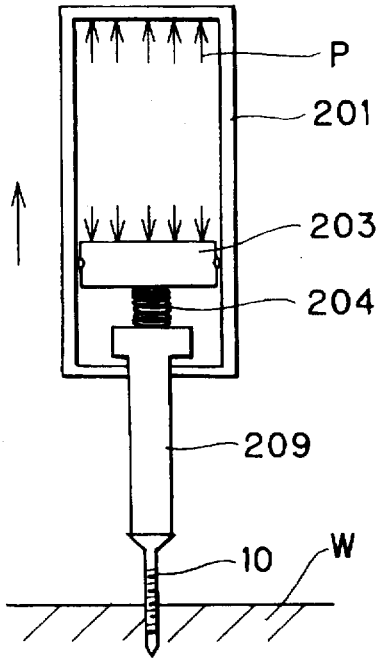
RELATED ART FIG. 10
FIG. 10 is a schematic view showing an operation principle of the inhouse proposal and showing a final phase of the screw driving operation.

On the other hand, according to the above described inhouse proposal, as shown in FIG. 9, the piston 203 is moved downwardly even after the tip end of the screw 10 abuts the workpiece W. In this case, the spring 204 can be shrunk, so that the repulsive force from the workpiece W can be reduced. To complete screw driving operation, the piston 203 is further moved downwardly by the compressed air with further shrinking the spring 204. In this case, since no stop member is provided, the compressed air exerted in the cylinder will urge the frame body 201 upwardly While the invention has been described in detail and with reference to the specific embodiments thereof, it would be apparent to those skilled in the art that various changes and modifications may be made therein without departing from the spirit and scope of the invention. For example, in the illustrated embodiment, the member to be attached to the base member is a soft member such as a plaster staff. However, the member to be attached can be a wood. In the latter case, the movable piston 3 or 103 must abuts the stop member 40, 140 before the tip end of the screw 10 abuts the surface of the wood. Further, in the depicted embodiment, the spring 4 is used for moving downwardly the moving unit 7 or 107. However, instead of the spring 4, other resilient member such as a rubber is available.

What is claimed is:

1. A pneumatically operated screw driver for driving a screw for threading engagement with a workpiece, comprising:

a frame body connected to a compressed air source;

a pneumatic motor supported in the frame body and rotatable about its axis by the compressed air;

a moving unit movable in an axial direction thereof and extending through the pneumatic motor, the moving unit including a drive bit engageable with a head of the screw and having an flange;

means for transmitting rotation of the pneumatic motor to the moving unit for rotating the moving unit about its axis, the transmitting means allowing the moving unit to axially move therethrough;

a movable piston supported on the moving unit and movable with respect to the moving unit in the axial direction thereof;

resilient member connected between the movable piston and the flange of the moving unit, the moving unit being movable in the axial direction thereof by the axial movement of the movable piston through the resilient member which is compressed; and, a stop member provided within the frame body at a stationary position and abuttable against the movable piston for stopping axial movement of the movable piston, the moving unit being further movable by a restoration force of the resilient member after the stop of the movable piston.

2. The pneumatically operated screw driver as claimed in claim 1, wherein the stop member is spaced away from the movable piston by a predetermined distance before contraction of the resilient member so that the movable piston abuts the stop member before a tip end of the screw abuts the workpiece which is made of such a material as to generate substantial resistive force against advancement of the screw.

3. The pneumatically operated screw driver as claimed in claim 2, wherein the pneumatic motor comprises a rotor having a central cylindrical bore, the movable piston being slidable with respect to the cylindrical bore.

4. The pneumatically operated screw driver as claimed in claim 3, wherein the stop member is provided at the cylindrical bore of the rotor at a position below the movable piston.

5. The pneumatically operated screw driver as claimed in claim 4, wherein the frame body provides an air inlet passage coaxially with the cylindrical bore, the air inlet passage having a radially inwardly projecting stepped portion, and wherein the moving unit comprises a valve seal portion movable through the air inlet passage and abuttable on the stepped portion to block fluid communication between the compressed air source and the pneumatic motor;

a spline shaft extending from the valve seal portion and engageable with the rotation transmitting means, the flange projecting from the spline shaft, the movable piston being coaxially and movably disposed over the spline shaft; and the drive bit extending coaxially with the spline shaft at a position therebelow.

6. The pneumatically operated screw driver as claimed in claim 5, wherein the movable piston is positioned above the rotation transmitting means.

7. The pneumatically operated screw driver as claimed in claim 2, wherein the pneumatic motor comprises a rotor having a central cylindrical bore, and a sleeve portion extending downwardly from the cylindrical bore, the movable piston being slidable with respect to the sleeve portion.

8. The pneumatically operated screw driver as claimed in claim 7, wherein the stop member is provided at a bottom portion of the frame body at a position in alignment with the movable piston.

9. The pneumatically operated screw driver as claimed in claim 8, wherein the frame body has a horizontal wall at a position above the pneumatic motor, and wherein the screw driver further comprising a cylindrical movable seal member disposed coaxially over the moving unit and movable in its axial direction and extending through horizontal wall with a space therebetween, an air inlet passage being defined at an outside of the cylindrical movable seal member for supplying the compressed air to the pneumatic motor.

10. The pneumatically operated screw driver as claimed in claim 9, wherein the movable seal member has an upper portion provided with a flange portion abuttable on the horizontal wall to shut off the air inlet passage for blocking fluid communication between the compressed air source and the pneumatic motor.

11. The pneumatically operated screw driver as claimed in claim 10, wherein the movable piston is positioned below the rotation transmitting means.

12. The pneumatically operated screw driver as claimed in claim 11, wherein the flange portion of the movable seal member is formed with an air passage for introducing the compressed air inside the movable seal member, and wherein the rotor is formed with an air passage at the cylindrical bore thereof for applying the compressed air to a top surface of the movable piston through the air passage.

13. The pneumatically operated screw driver as claimed in claim 12, wherein the cylindrical movable seal member has a lower portion provided with a radially inwardly projecting rib, and wherein the moving unit comprising a large diameter portion movable through the cylindrical movable seal member and abuttable on the radially inwardly projecting rib to prevent the compressed air from being supplied to the pneumatic motor;

a spline shaft extending from the large diameter portion and engageable with the rotation transmitting means, the flange projecting from the spline shaft, the movable piston being coaxially and movably disposed over the spline shaft; and the drive bit extending coaxially with the spline shaft at a position therebelow.

* * * * *